US009435129B1

(12) United States Patent
Horne

(10) Patent No.: US 9,435,129 B1
(45) Date of Patent: Sep. 6, 2016

(54) CEMENT LAP SIDING HANDLING AND INSTALLATION TOOLS AND METHOD OF USING

(71) Applicant: Patrick M Horne, Waverly, GA (US)

(72) Inventor: Patrick M Horne, Waverly, GA (US)

( * ) Notice: Subject to any disclaimer, the term of this patent is extended or adjusted under 35 U.S.C. 154(b) by 0 days.

(21) Appl. No.: 14/740,714

(22) Filed: Jun. 16, 2015

Related U.S. Application Data

(60) Provisional application No. 62/014,375, filed on Jun. 19, 2014.

(51) Int. Cl.

| | |
|---|---|
| ***E04D 15/00*** | (2006.01) |
| ***E04F 21/00*** | (2006.01) |
| ***E04G 21/14*** | (2006.01) |
| ***E04G 21/16*** | (2006.01) |
| ***E04F 21/18*** | (2006.01) |
| ***E04F 13/21*** | (2006.01) |
| *E04D 15/04* | (2006.01) |
| *E04D 15/02* | (2006.01) |

(52) U.S. Cl.
CPC ..... *E04G 21/16* (2013.01); *E04F 13/21* (2013.01); *E04F 21/18* (2013.01); *E04D 15/00* (2013.01); *E04D 15/025* (2013.01); *E04D 15/04* (2013.01); *E04F 21/1855* (2013.01)

(58) Field of Classification Search
CPC ..... E04D 15/00; E04D 15/025; E04D 15/04; E04F 21/1855
USPC ..... 52/748.1, 749.1, 749.13, 478, 127.1, 52/549, 547, 553, DIG. 1; 248/225.21, 248/244, 322, 307, 215, 304, 300, 340, 303, 248/301, 453; 33/647, 613, 646; 269/296; D6/552
See application file for complete search history.

(56) References Cited

U.S. PATENT DOCUMENTS

| | | | | | |
|---|---|---|---|---|---|
| 4,089,141 | A * | 5/1978 | Heroux | E04F 21/1855 | 269/102 |
| 4,164,346 | A * | 8/1979 | Sickler | E04F 21/1855 | 269/289 MR |
| 4,193,495 | A * | 3/1980 | Keeley | A63B 71/0045 | 211/60.1 |
| D268,461 | S * | 4/1983 | Wess | D3/259 | |
| 4,958,594 | A * | 9/1990 | Swagerty | B68C 1/002 | 119/400 |
| 5,738,319 | A * | 4/1998 | Grassi | A47G 7/044 | 248/215 |
| 6,705,021 | B2 * | 3/2004 | Nadal | E04F 21/1855 | 33/411 |
| 7,434,329 | B2 * | 10/2008 | Walda | E04F 13/0864 | 33/649 |
| 7,669,819 | B2 * | 3/2010 | Meyers | A47B 96/06 | 211/119.004 |
| 7,789,248 | B1 * | 9/2010 | Salerno | A47G 25/08 | 211/106.01 |
| 7,992,833 | B1 * | 8/2011 | Goodman | A47G 25/0614 | 248/298.1 |
| 2004/0123478 | A1 * | 7/2004 | Partin | E04F 21/1855 | 33/647 |
| 2015/0033571 | A1 * | 2/2015 | Walker | E04F 21/1855 | 33/647 |

* cited by examiner

*Primary Examiner* — Chi Q Nguyen
(74) *Attorney, Agent, or Firm* — Jonathan R. Smith; Jonathan Rigdon Smith, J.D., PC

(57) ABSTRACT

A tool kit makes it possible for one person to pick up one or more frangible elongate workpieces such as strips of cement lap siding using a first part of the invention, and properly position each one on, and affix it to, a vertical surface such as an exterior wall using a second part of the invention.

9 Claims, 8 Drawing Sheets

CEMENT LAP SIDING HANDLING AND INSTALLATION TOOLS AND METHOD OF USING

CROSS-REFERENCES TO RELATED APPLICATIONS

This application for patent claims priority of U.S. provisional patent application Ser. No. 62/014,375 filed Jun. 19, 2014.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not Applicable.

BACKGROUND OF INVENTION

1. Field of the Invention

This invention is in the fields of hand tools, building and construction, and supports, and more specifically in the field of installing lap siding on buildings.

2. Description of the Related Art

Lap siding is a common type of siding for buildings. Lap siding refers generally to siding in which multiple strips of siding are attached to the building in a partially overlapping fashion. More specifically, a first strip is attached at the lower extent of the face of the building to be sided and then additional strips are attached above it, with each additional strip at least partially overlapping the strip below it. The distance from the bottom of a strip to the bottom of the strip above it is referred to as a "reveal." A reveal may also be defined as the height of the siding strip less the amount of overlap by the strip installed above it, or more simply, the vertical or generally vertical portion of each siding strip that is seen after installation is complete. Mechanical fastening of siding strips to the face of a building is most commonly achieved through the use of a pneumatic nail gun or similar device that may be operated with one hand.

A challenge when installing lap siding is to create uniform and level reveals, while at the same time addressing the occasional need to intentionally vary reveal sizes by incremental units to correct for any number of construction variances, such as if the ends of a building vary slightly in height or a window has been installed out-of-level. Another challenge is the ability to hold a siding strip properly and firmly to prevent slippage during mechanical fastening. Further, siding installers face the constant challenge of having to carry and use many individual tools, such as a level, straight edge for marking lines, hammer, tape measure, etc., which tends to be cumbersome and hazardous, particularly when working on scaffolding.

One common installation method used to achieve the desired reveals described above is to manually mark lines at taped intervals at each end of a previously fastened siding strip. The next siding strip to be installed is then aligned visually and hand-held during mechanical fastening. A disadvantage of this method is the added installation time required to measure and mark lines for each siding strip. In addition, measurements and markings of lines, as well as visual alignment of siding strips to said lines, can vary from person to person, from one end of the strip to the other, and from strip to strip, thus introducing cumulative errors of scale and human error resulting in non-uniform reveals and siding strips installed out of level. Furthermore, this method requires the installer to hand-position and hold each strip of siding during mechanical fastening, which can result in inadvertent slippage or movement of the siding.

Another installation method is to use blocks of wood, cut to the desired reveal size, as spacers that two installers can hold at each end of a siding strip, with the bottom of the block aligned with the bottom of the previously fastened strip and the top of the block providing a surface upon which the next siding strip can sit during mechanical fastening. Disadvantages of this method are that individual blocks of wood can vary in length, are susceptible to shrinking and swelling due to differences in moisture content, and deform after repeated use due to the wearing of the edges of the seated siding on the top of the block, all of which contribute to the aforementioned cumulative errors. In addition, the use of blocks as spacers requires the visual alignment of the bottom of the block with the bottom of the previously fastened strip of siding, and further introduces human error, especially because different individuals will be visually aligning each side of the lap siding. Further, while providing a seat for a siding strip to be installed, this method does not prevent lateral movement (outward from the building face) of the siding and can easily result in vertical slippage relative to the previously installed strip of lap siding, thereby requiring two hands to hold the siding strip and block in place.

Existing tools and devices for installing lap siding are disclosed in U.S. Pat. Nos. 4,473,100, 4,484,392, 4,425,714, 5,408,757 and 6,684,521, the disclosures of which are hereby incorporated by reference. However, the devices disclosed in such patents, while somewhat useful when employed by a single installer, consist of tools that are of substantially fixed structures and which have proven to be inconvenient for rapid and efficient use. The devices are relatively complex in structure, are difficult to remove once a siding strip is fastened, and have a tendency to break or damage the siding during removal. These devices also require at least two workers to install a single strip of siding, and do not provide for moving elongate siding strips from, e.g., a vehicle to the location of installation without risk of damage to the siding. The risk of damage or breakage is particularly acute with cement siding.

BRIEF DESCRIPTION OF THE INVENTION

Objects of the Invention

An object of the invention is to provide a tool and method to enable one person to move elongate siding strips from one location to another without risk of damage to the siding. A further object of the invention is to provide a tool and method to position a strip of siding in proper relation to the previously-installed strip.

SUMMARY OF THE INVENTION

The first part of the invention is a siding holder that one person can attach to a strip of lap siding on the ground or a vehicle and use it to move the strip to sawhorses if necessary and from there to the wall upon which it is to be installed, even if up a ladder, without risk of breakage. Cement siding, in particular, is very frangible. The second part is a plurality of wall hangers that enable one person to position and affix the siding correctly on the wall directly from the siding holder, and then move the wall hangers to the next location without damaging the wall, the siding, or the positioners.

DETAILED DESCRIPTION OF THE INVENTION

Figure 1:
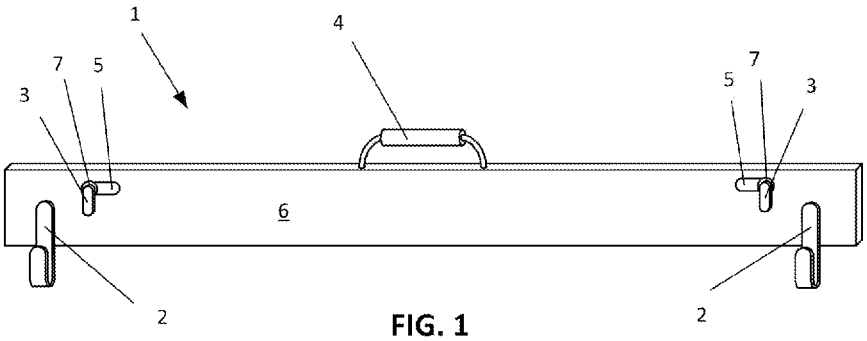
FIG. 1 is a front view of the siding handler part of the present invention in its locked state.

Referring now to the drawings, in which like reference characters refer to like elements among the drawings, FIG. 1 is a front view of the siding handler part 1 of the present invention in its locked state. It comprises an elongate beam 6 with a handle 4 attached to the top of the beam near its midpoint so that the beam and its load may be carried it in a more or less balanced position with one hand. Proximate to the right and left ends of beam 6 are hooks 2, and above the hooks are rotatable bars 3. The bars 3 are rotatable about axles (not visible) that pass through bushings 7 to the opposite side of beam 6. The bars 3 are shown in a vertical orientation and are displaced forwardly in this view to provide a space between them and beam 6. When the left-hand bar 3 in this view is rotated counterclockwise in this view a quarter turn, it can be pulled toward beam 6 and retracted into a recess 5 so that bar 3 is more or less flush with beam 6. The right-hand bar operates in the same fashion and is shown as a mirror image of its left-hand counterpart, although it is within the scope of this invention for both bars to be oriented alike. In other embodiments, beam 6 need not be a flat panel as depicted here but can consist of rigid rods or bars connecting the various parts enumerated above so long as they operate as described further below.

Figure 2:
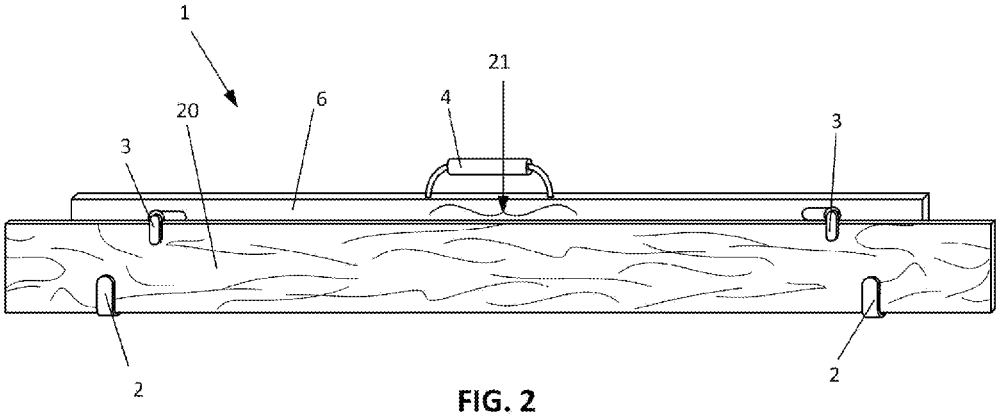
FIG. 2 is a front view of the siding handler part of the present invention carrying a strip of siding in its locked state.

FIG. 2 is a front view of the siding handler part 1 of the present invention carrying a strip 20 of siding. Handler part 1 holds the lower edge of the strip of siding 20 in the two hooks 2 on the bottom and the two bars 3 on the top keep the siding from leaning over. The handler part 1 is in its locked state, meaning that bars 3 are vertical and far enough in front of beam 6 to hold strip 20. Bars 3 may, within the scope of the present invention, be kept from moving too far forward (away from the page) by short axles connecting them to handles on the other side (not visible; see FIG. 3) or by biasing means, e.g., springs, that pull the bars toward beam 6 and into recesses 5.

The handler part 1 is used to pick up one or more strips 20 of siding by placing the front face of beam 6 on top of the center portion 21 of the strip and sliding the hooks 2 onto one elongate edge of the strip. The bars 3 are then rotated toward the hooks, securing strip 20 against beam 6. Because certain siding strips are frangible, particularly cement siding, it is essential that torque on the strip be kept to a minimum. Once the strip is secured, handle 4 can rotated to a vertical position while the widely-separated hooks and bars simultaneously lift the strip in two places. Once in the vertical orientation as shown in FIG. 2, the siding strip will stay level as it is carried and continue to be supported in two places so that it does not break as it is moved from one location to another.

Within the scope of the present invention, the handler part 1 can be used to carry other long materials. It can be attached directly to the wall to install siding or to install fascia boards around a roof.

The beam 6 can be a piece of lumber, hard piece of plastic or metal. The lifting hooks 2 are preferably metal attached to the beam with screws, rivets, or welds, depending on the material from which the beam is made. The handle 4 is preferably a metal bar bolted through the central portion of the beam 6 with recessed nuts on the bottom or just molded into with the main body with whatever material is being used to construct it.

Figure 3:
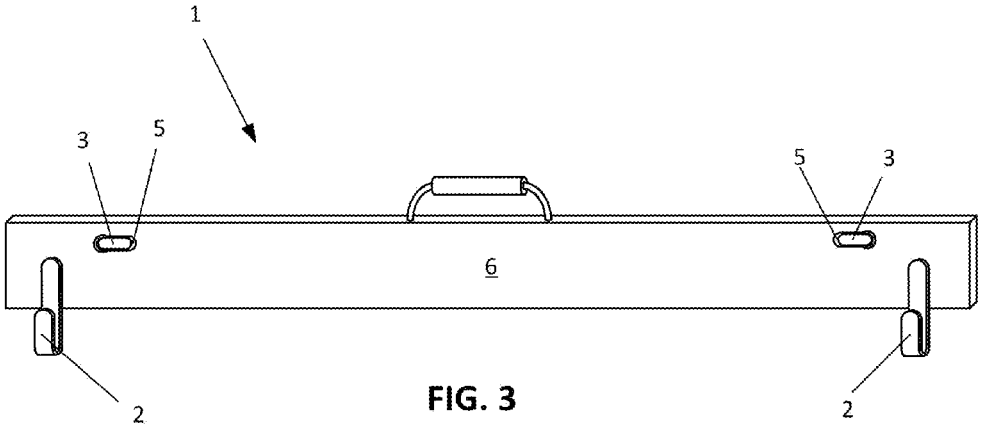
FIG. 3 is a front view of the siding handler part of the present invention in its unlocked state.

FIG. 3 is a front view of the siding handler part 1 of the present invention in its unlocked state. Bars 3 are shown retracted into recesses 5, allowing beam 6 to be placed over a siding strip (not shown) so that hooks 2 can engage it.

Figure 4:
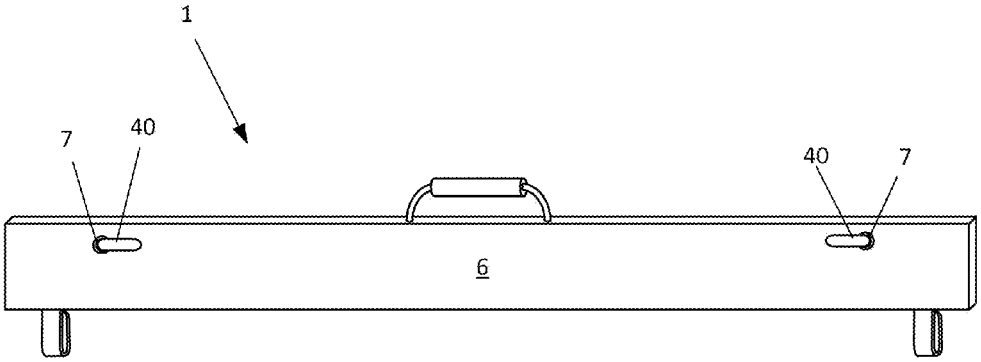
FIG. 4 is a rear view of the siding handler part of the present invention in its unlocked state.

FIG. 4 is a rear view of the siding handler part 1 of the present invention in its unlocked state. Locking bar grips 40 at either end of beam 6 are connected to locking bars 3 (see FIGS. 1 and 2) via axles (not visible) through bushings 7. They are both disposed horizontally, which corresponds to horizontal (unlocked) orientation of bars 3 on the other side.

Figure 5:
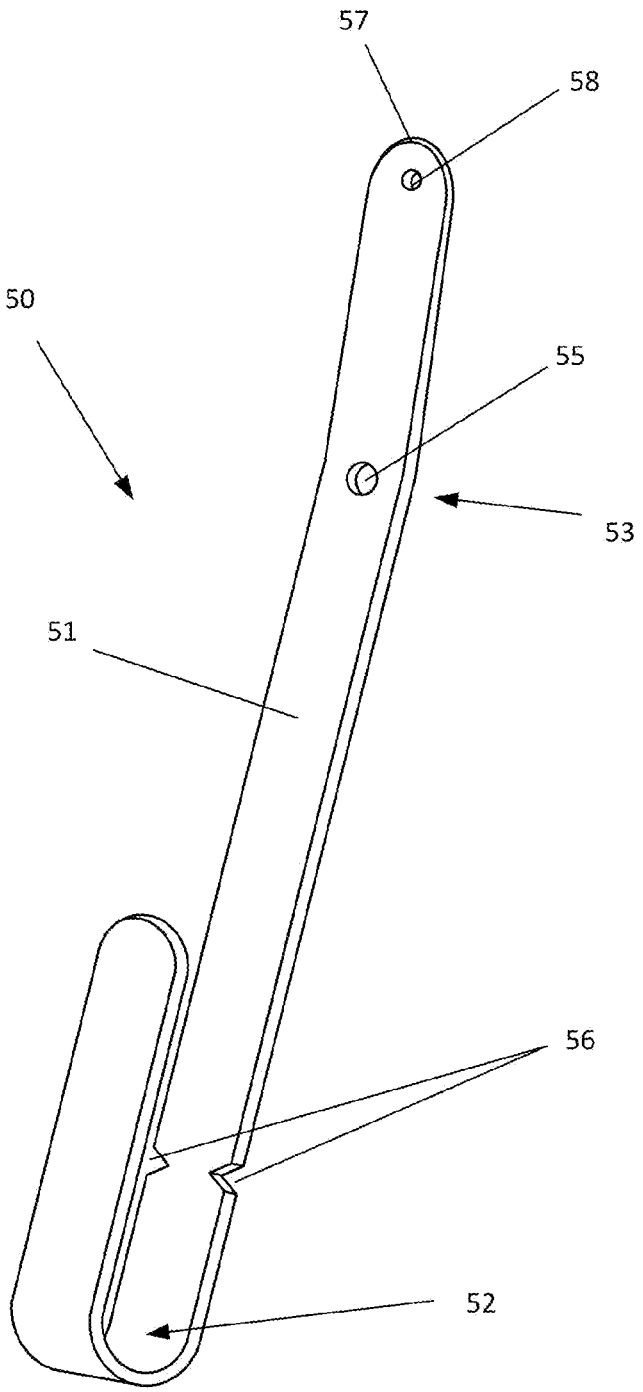
FIG. 5 is an oblique view of the wall hanger part of the present invention.
Figure 6:
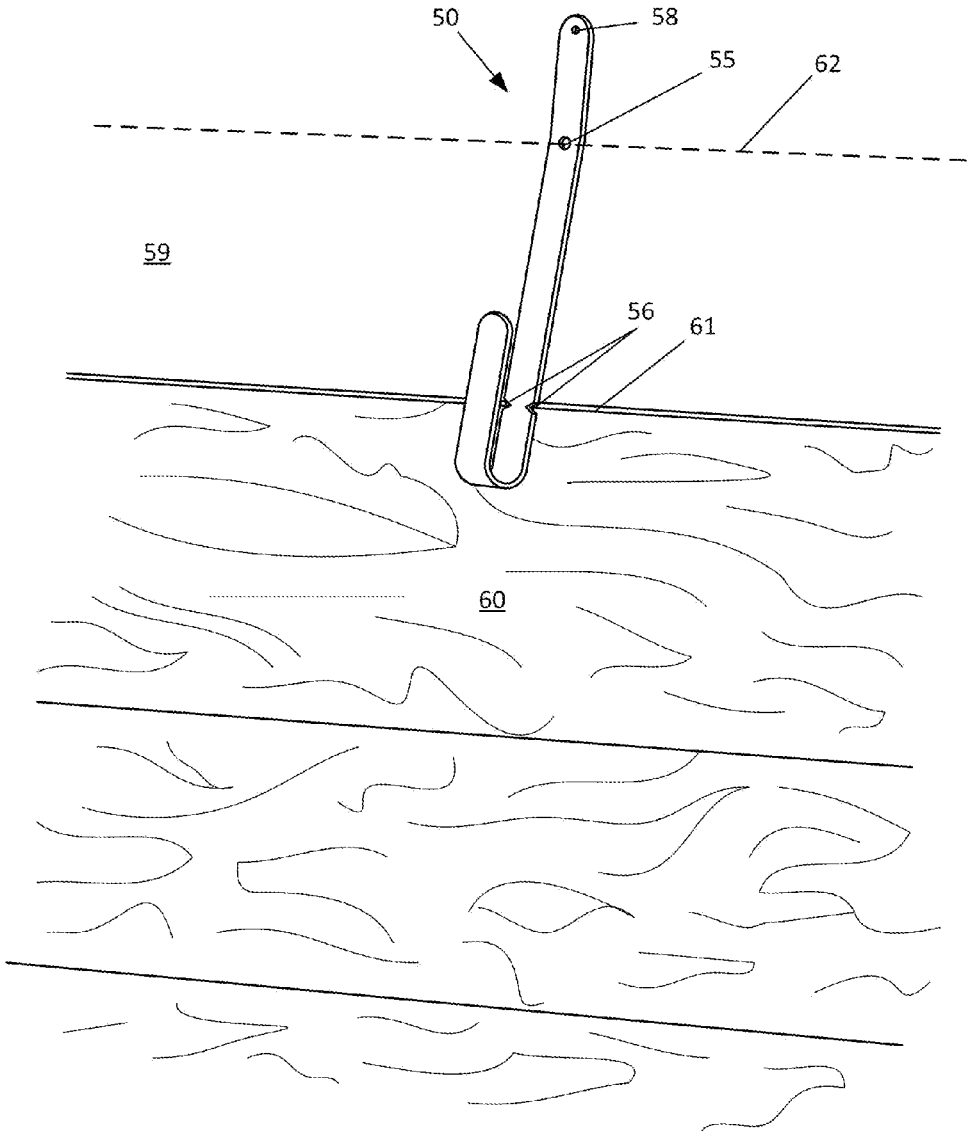
FIG. 6 is an oblique view of the wall hanger part of the present invention located on a wall to receive a strip of siding.
Figure 11:
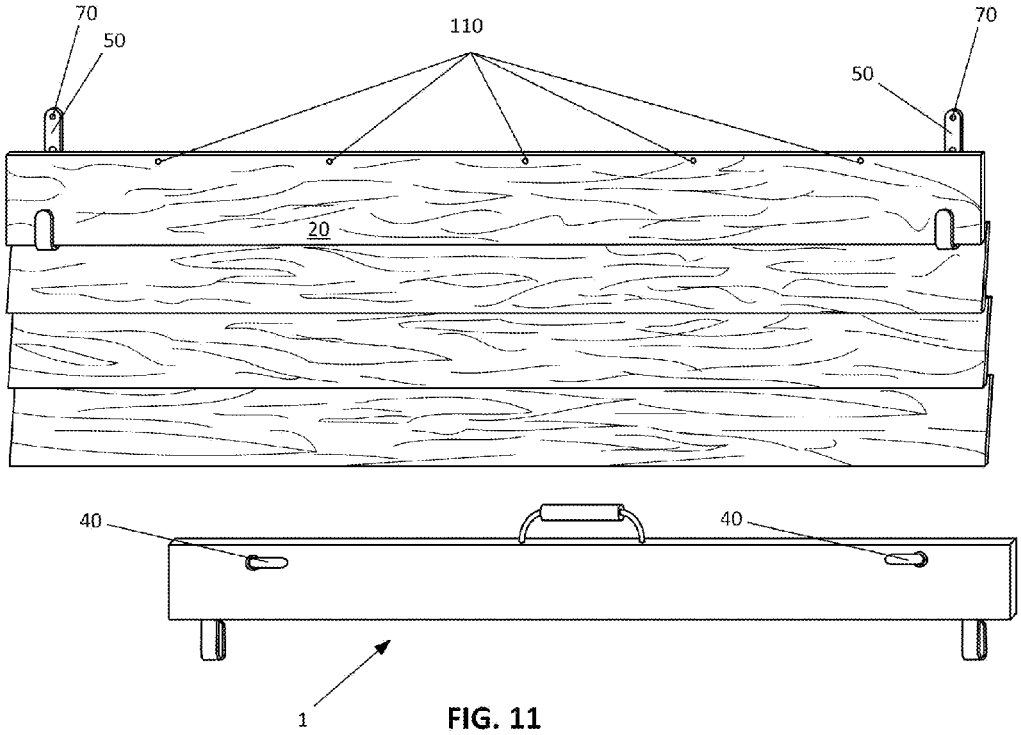
FIG. 11 is a view facing a wall showing the siding handler part of the present invention and the pair of wall hangers removed from the wall, leaving the siding strip nailed in place.

FIG. 5 is an oblique view of the wall hanger part 50 of the present invention. Preferably two wall hanger parts 50 are used to receive a siding strip from the siding handler part of the invention and hold the siding up so it can be leveled and nailed without having to support it by hand. Each wall hanger part 50 is a shaped band 51 of rigid and resilient, preferably but not exclusively, hardened steel. A single wall hanger part 50 can be used as a nail remover or as a pry bar. The wall hanger part 50 comprises an approximately 180° bight 52 at its lower end, which must be wide enough to accept the edges of typical siding strips. The middle part 53 of the band 51 preferably has a slight bend 54 in it to provide for the fact that the faces of siding strips angle outward slightly from the wall to which they are attached (as shown in FIG. 6). A chalk line sighting means (in this embodiment, a sight hole 55) is cut through middle part 53, and further below, a siding edge sighting means (in this embodiment, notches 56) are cut into the band 51. Preferably, both of these means are included in the present invention, but the wall hanger part may have one or the other. Moreover, means providing the user with the ability to position wall hanger part 50 visually other than the aforementioned, such as grooves or printed indicia, are within the scope of this invention without limitation. Proximate to the top end 57 of the wall hanger part 50 is a nail hole 58. The band 51 may be tapered as shown to a lesser thickness from sight hole 55 toward top end 57. Such tapering is beneficial in reducing the potential effect of loosening a freshly nailed siding strip when the hanger part 50 is pulled downwardly out from under it as shown in FIG. 11. Such tapering also reduces the force necessary to push the hanger part 50 under a strip of siding, and the potential concomitant damage to the surface to the siding, should it become necessary to reinsert it.

FIG. 6 is an oblique view of one wall hanger part 50 of the present invention located on a wall 59 to receive a strip of siding. As is typical, siding strips are applied starting at the bottom of a wall and added moving upward. The last strip installed in this view is strip 60. A wall hanger part 50 is positioned by aligning notches 56 with the upper edge 61 of strip 60 and/or aligning a chalk line 62 with the center of sight hole 55. The hanger part 50 is then temporarily tacked to the wall by driving a nail or tack through nail hole 58.

Figure 7:
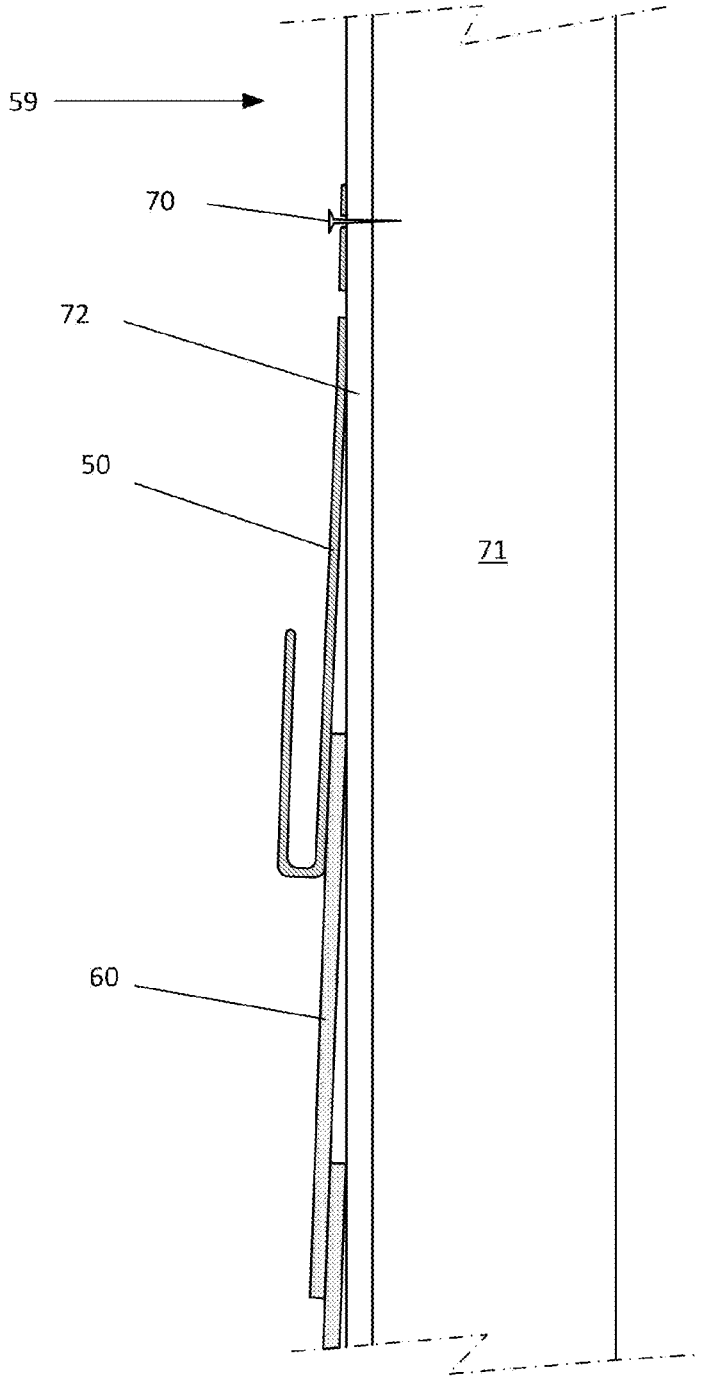
FIG. 7 is a side cross-sectional view of the wall hanger part of the present invention located on a wall to receive a strip of siding.

FIG. 7 is a side cross-sectional view of the wall hanger part 50 of the present invention located on a wall 59 to receive a strip of siding to lap over preexisting strip 60. It is a side view of what is depicted in FIG. 6. Note that hanger part 50 is fastened to wall 59 by a tack 70. A 2×4 stud 71 is shown backing the wallboard 72 but it is not essential that tack 70 be driven through wallboard 72 into stud 71. In fact it is preferable that tack 70 not be driven in completely because after the next siding strip is added, the tack 70 must be removed.

Figure 8:
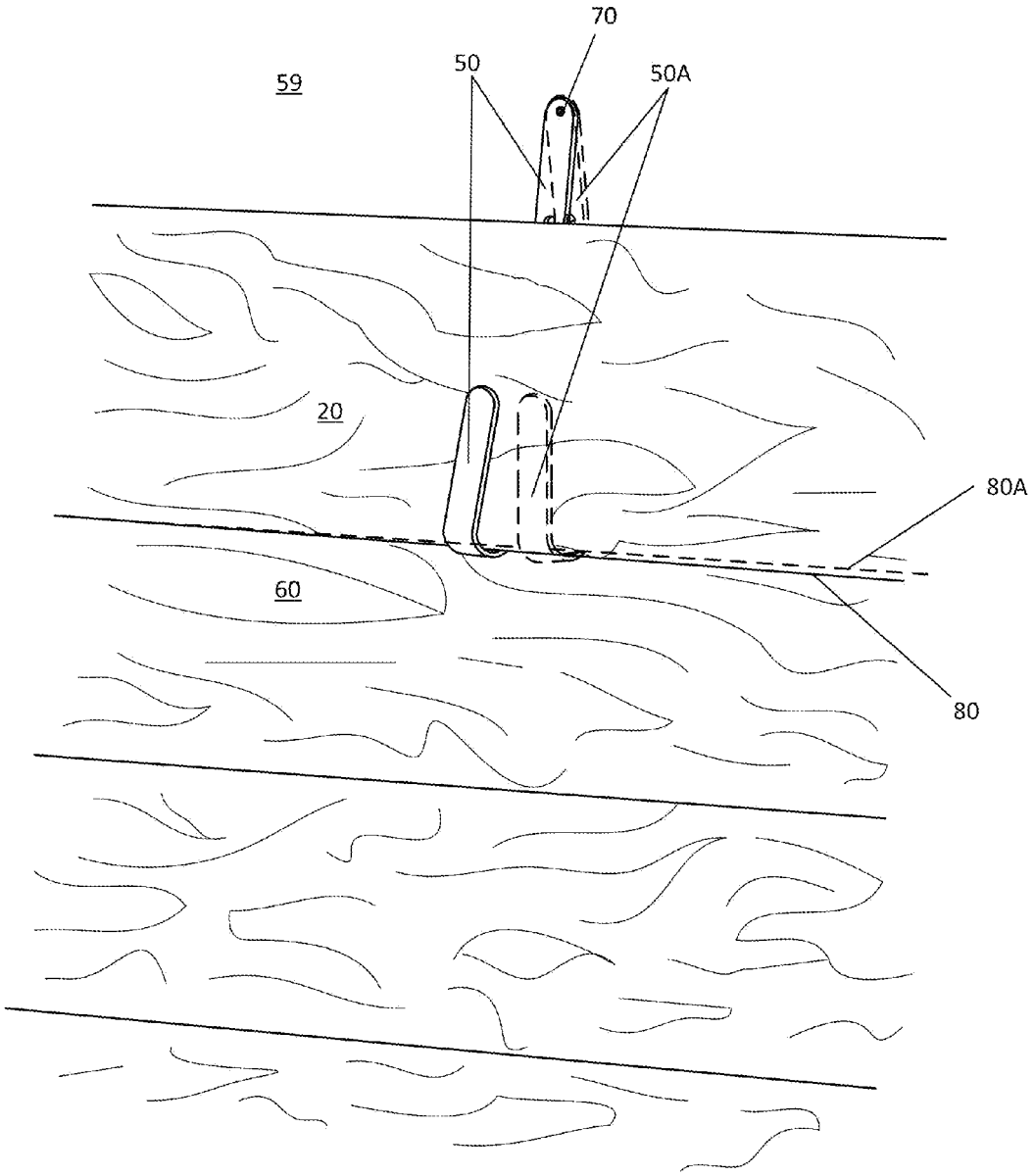
FIG. 8 is an oblique view of the wall hanger part of the present invention located on a wall and holding a strip of siding.

FIG. 8 is an oblique view of the wall hanger part 50 of the present invention located on a wall 59 and holding a new siding strip 20 of siding. The strip 20 is level because an identical wall hanger part, also aligned with the upper edge (not visible) of preexisting strip 60 or the chalk line (not visible) is supporting the same strip 20 at another location out of this view.

This invention provides a leveling correction feature in the event that wall hanger part 50 was not positioned accurately or perhaps an eyeball adjustment of the alignment of the siding strip 20 is desired to compensate for apparent small misalignments. The height of the bottom edge 80 of strip 20 can be micro-adjusted by tapping the bottom of the wall hanger part 50 one way or the other to pivot it about tack 70. In this case, the bottom edge 80 has been raised to position 80A by moving wall hanger part 50 rightward to position 50A (dashed lines).

Figure 9:
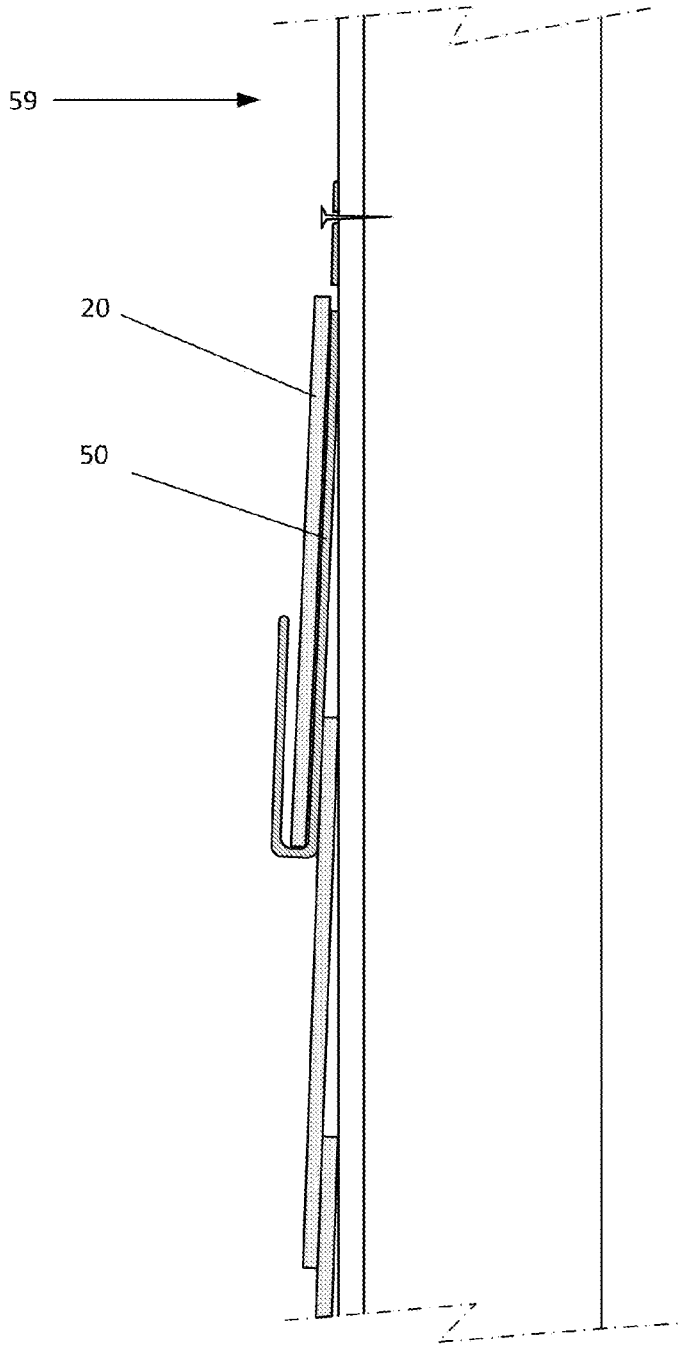
FIG. 9 is a side cross-sectional view of the wall hanger part of the present invention located on a wall and holding a strip of siding.

FIG. 9 is a side cross-sectional view of the wall hanger part 50 of the present invention located on wall 59 and holding the new siding strip 20.

Figure 10:
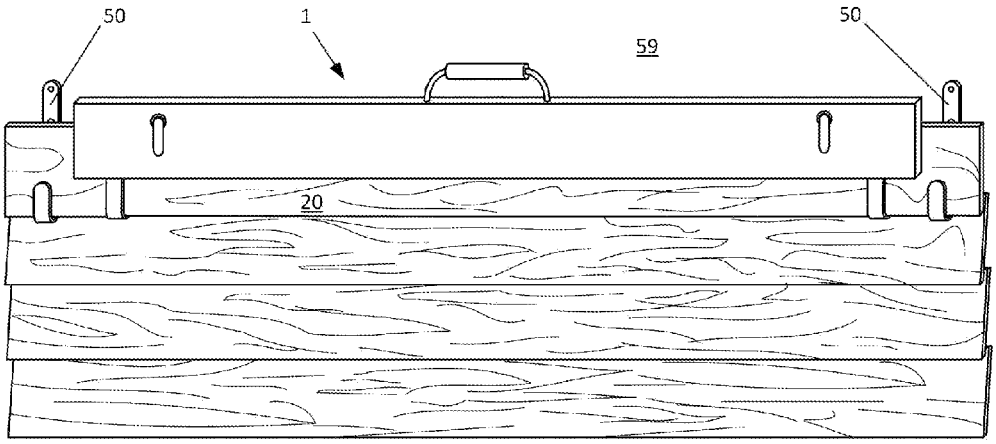
FIG. 10 is a view facing a wall showing the siding handler part of the present invention positioning a strip of siding into a pair of wall hangers.

FIG. 10 is a view facing wall 59 showing the siding handler part 1 of the present invention positioning a new siding strip 20 into a pair of wall hanger parts 50. If the hooks 2 (see FIGS. 1-3) have sufficient width, the siding handler part can carry more than one siding strip at a time, which allows it to place additional pieces of siding into additional, or repositioned, hanger parts 50 (see FIG. 5).

FIG. 11 is a view facing the wall 59 showing the siding handler part 1 of the present invention removed from the underneath new siding strip 20 while the strip 20 is still being supported by two wall hanger parts 50. To remove the siding handler part 1, the two grips 40 must be turned from vertical to horizontal orientation to rotate the bars (not visible) on the other side of the handler part 1 to release the siding strip. Siding nails 110 have been driven into strip 20 near its upper edge so that their heads will be covered by the next strip. The wall hanger tacks 70 can then be pulled, allowing wall hanger parts 50 to be removed by sliding them downward. This is made easier and less likely to disturb the newly-fastened siding strip 20 because of the slight bend and tapered upper tips on the wall hanger parts 50 (see FIG. 5).

A more general way of describing the present invention is a kit comprising two parts. The first part is a handling part 1 comprising a beam 6 having a horizontal extent, the horizontal extent having a right end and a left end; a vertical extent at each end having a top and a bottom; the horizontal and vertical extents defining a substantially vertical plane having a forward face and a rearward face; and a central portion along the horizontal extent between the right end and the left end. A simple form of beam 1 is a rectangular plank as shown in FIGS. 1-4, 10 and 11, although in general terms the beam could be made of rigid bars or pipes to which the described elements could be attached as equivalent forms.

The beam 6 further has a handle 4 fixed to the central portion to enable the beam to be carried approximately horizontally, and a pair of shaped hooks 2 fixed proximate to the right and left ends of beam 1, proximate to the bottom, and extending forwardly from the front of the beam 6. The hooks are each shaped to temporarily engage the bottom edge of an elongate workpiece from underneath the workpiece. The inspiration for the invention is to pick up and move a piece of cement lap siding in a way that will keep it from breaking, which is what can happen if it is picked up by hand, but the scope of the invention extends to other essentially rectangular strips of material.

The beam 6 has a pair of bars 3 rotatably attached to the beam 6 proximate to the right and left ends, proximate to the top edge, and positioned in front of the beam 6 to temporarily engage the top edge of the elongate workpiece. Each of the bars 3 comprises means for moving the bar forward and rearward relative to the vertical plane of the beam. The embodiment of the invention shown in the drawings shows these bars 3 connected by axles through the beam 6 to hand grips 40. The beam 6 is provided with recesses 5 near each end which allow the user to pull the bars rearward so that they are flush with the front of the beam.

The means for moving a bar 3 comprises an axle extending from the bar rearward to the rear of the vertical plane, and a grip 40 affixed to the axle. It is within the scope of this invention to insert a biasing means (e.g., spring, not shown) around the axle between the grip and the rear surface of the beam that will automatically pull the bar back into the recess 5 when the grip is used to turn the bar to the horizontal orientation.

The second part of the kit is two (or more) hangers, one of which is shown in FIG. 5. Each hanger 50 has an upward-facing bight 52 ("bight" being a hook as distinguished from the "hooks" on the handling part) at the bottom, and at least one means for aligning the hanger with a horizontal position mark on a wall such as a chalk line 62 or the top of another workpiece 61. Hanger 50 is shown as a bent, flat band with both a sight hole 55 and notches 56, but in a more general sense it could be cut from a block of wood, a metal pipe, a piece of angle iron, etc., so long as it has the elements described. The bight is on the front side of the hanger when the hanger is tacked to a vertical surface. The band is shown slightly bent at 53 because the back side of siding generally slopes away from vertical. This is because it laps over the siding strip below it. The top end of the hanger 50 has a tack hole 58 through it so that it may be fixed temporarily to the vertical surface, although in embodiments the hole could be replaced by a hook or rearward-facing barb. In embodiments, the top end of the hanger is preferably tapered, that is, thinner from front to back as shown in FIG. 5. This both minimizes the distance between the top edge of the workpiece being installed and the vertical surface, and makes it easier to slide the hanger up and down between the workpiece being installed and the vertical surface and the preceding workpiece.

The preferred method for using the kit comprises the steps of: (a) establishing a horizontal position mark on a vertical surface 53 (which can be either chalk line 62 or the top of a preceding workpiece 61); (b) placing the rearward vertical contacting face of one of the two hanger parts 50 against the vertical surface 59, aligning at least one of the means 55 and/or 56 for aligning the hanger part with the horizontal position mark, and driving the means for temporarily affixing the hanger part to the vertical surface, e.g., a tack 70 through the tack hole 58 or a barb, into the vertical surface; (c) performing step (b) with the other of the two hanger parts; (d) arranging the bars 3 of the handler part 1 into horizontal alignment; (e) placing the bottom edge of an elongate workpiece 20 into the pair of shaped hooks 2; (f) turning the bars 3 into vertical alignment forwardly of the elongate workpiece; (g) placing the bottom edge into the bights 52 on the hanger parts 50 that have been temporarily affixed to the vertical surface; (h) turning the bars 3 into horizontal alignment; (i) leaning the top edge of the elongate workpiece against the vertical surface; (j) sliding the shaped hooks 2 downwardly to release the elongate workpiece into the bights 52; (k) nailing the elongate workpiece proximate to the top edge to the vertical surface; (l) disconnecting the hanger parts 50 from the vertical surface by, e.g., unfastening barbs, if applicable, or pulling the tacks 70 out of the tack holes 58; and (m) sliding the hanger parts downwardly to disengage them from the vertical surface 59 and the elongate workpiece 20.

After step (j), the elevation of the bight 52 of at least one of the two hanger parts 50 is adjusted by tapping the lower end of the hanger part right or left along the bottom edge of the elongate workpiece.

Of course, steps (a) through (c) can be performed after step (f) within the scope of this invention. Also note that in practice, and within the scope of the claimed method, step (e) can be performed on an elongate workpiece as it is lying flat on the ground, a truck bed, or a stack of other workpieces, etc., by rotating the handler part 1 so that its forward face is horizontal and hooks 2 face downwardly. The bottom edge of an elongate workpiece 20 that is lying flat can then be slid into the pair of hooks by working the forward- (now downward-) facing hooks in between workpiece and the surface below it. Step (f) can be performed after handle 4 is used to tilt the workpiece and raise its upper edge slightly.

While the invention has been described in connection with what is presently considered to be the most practical and preferred embodiment, it is to be understood that the invention is not to be limited to the disclosed embodiment, but on the contrary, is intended to cover various modifications and equivalent arrangements.

The invention claimed is:

1. A tool kit, comprising:

a handling part comprising a beam having a horizontal extent, the horizontal extent having a right end and a left end; a vertical extent at each end having a top and a bottom; the horizontal and vertical extents defining a substantially vertical plane having a forward face and a rearward face; a central portion along the horizontal extent between the right end and the left end;

a handle fixed to the central portion to enable the beam to be carried approximately horizontally;

a pair of shaped hooks fixed proximate to the right and left ends and proximate to the bottom;

the hooks each being shaped to temporarily engage the bottom edge of an elongate workpiece from underneath the elongate workpiece;

a pair of bars rotatably attached to the elongate beam proximate to the right and left ends, proximate to the top, and positioned in front of the vertical plane to temporarily engage the top edge of the elongate workpiece; and at least two hanger parts comprising means for temporary attachment to a substantially vertical surface;

each of the at least two hanger parts comprising:

at least one means for aligning the elongate workpiece with a horizontal position mark on the vertical surface; and an upward-facing bight for temporarily holding the bottom edge of the elongate workpiece.

2. The tool kit of claim 1, wherein:

each bar of said pair of bars comprises means for moving the bar forward and rearward relative to said vertical plane;

the means for moving the bar comprising an axle extending from the bar rearward to the rear of said vertical plane, and a grip affixed to the axle.

3. The tool kit of claim 2, wherein:

said means for moving said bar comprises a means for biasing said bar towards the rear.

4. The tool kit of claim 2, wherein:

each of said hanger parts comprises a rigid shaped band having a substantially vertical surface contacting face, an upper end, a middle portion, a lower end, and two substantially parallel sides;

a means for temporarily attaching the hanger part to the vertical surface, proximate to the upper end;

said upwardly-facing bight being proximate to the lower end and bending forwardly; and said at least one means for aligning said hanger part with said horizontal position mark on said vertical surface is taken from the following list of:

(a) at least one sight hole through said hanger part, (b) at least one notch in at least one side, and (c) at least one mark proximate to at least one side.

5. A method for using the tool kit of claim 4, comprising the steps of:

(a) establishing a horizontal position mark on a vertical surface;

(b) placing said vertical contacting face of one of said two hanger parts against the vertical surface, aligning at least one of said at least one means for aligning said hanger part with the horizontal position mark, and driving said means for temporarily attaching the hanger part to the vertical surface into the vertical surface;

(c) performing step (b) with the other of said two hanger parts;

(d) arranging said bars into horizontal alignment;

(e) placing the bottom edge of at least one of said elongate workpieces into said pair of shaped hooks;

(f) turning said bars into vertical alignment forwardly of said at least one elongate workpieces;

(g) placing said bottom edge of one elongate workpiece into said bights;

(h) turning said bars into horizontal alignment;

(i) leaning said top edge of the one elongate workpiece against the vertical surface;

(j) sliding said shaped hooks downwardly to release the one elongate workpiece into said bights;

(k) nailing the one elongate workpiece proximate to said top edge to the vertical surface;

(l) pulling said means for temporarily attaching the hanger part to the vertical surface out of the vertical surface; and (m) sliding said hanger parts downwardly to disengage them from said vertical surface and said one elongate workpiece.

6. The method of claim 5, in which:

after step (j), the elevation of said bight of at least one of said two hanger parts is adjusted by tapping said lower end right or left along said bottom edge of said one elongate workpiece.

7. A tool kit, comprising;

an elongate substantially rectangular beam having a right end and a left end; a top and a bottom; a forward face and a rearward face; a central portion along the top;

a handle fixed to the central portion to enable the beam to be carried approximately horizontally;

a pair of shaped hooks fixed proximate to the right and left ends and proximate to the bottom;

the hooks each being shaped to temporarily engage the bottom edge of at least one strip of siding;

a pair of bars rotatably attached to the beam proximate to the right and left ends, proximate to the top, and positioned in recesses in the forward face; each bar comprising means for moving the bar forward and rearward relative to the forward face;

the means for moving the bar comprising an axle extending from the bar rearward to the rearward face, and a grip affixed to the axle and behind the rearward face.

8. The tool kit of claim 7, further comprising:

two hanger parts each comprising: a vertical rigid metal band having parallel left and right edges and bent to form a bight at the bottom end; a tack hole at the top end; and at least one means for aligning the band vertically in relation to at least one horizontal position mark on a vertical surface.

9. The tool kit of claim 8, in which:

said at least one means for aligning each of said bands vertically comprises a sight hole displaced downwardly from said tack hole, and a pair of notches displaced upwardly from said bight and horizontally opposite each other on said left and right edges.

* * * * *